United States Patent [19]

Chanin

[11] 4,214,752

[45] Jul. 29, 1980

[54] TABLE TENNIS BALL GUARD

[76] Inventor: Harold Chanin, 5 Sheffield St., Lake Hiawatha, N.J. 07034

[21] Appl. No.: 922,304

[22] Filed: Jul. 6, 1978

[51] Int. Cl.[2] ..... A63B 67/04

[52] U.S. Cl. ..... 273/30

[58] Field of Search ..... 273/30, 102 R

[56] References Cited

U.S. PATENT DOCUMENTS

| | | | |
|---|---|---|---|
| 2,161,463 | 6/1939 | Frost | 273/30 |
| 2,174,884 | 10/1939 | Kachel | 273/30 |

FOREIGN PATENT DOCUMENTS

| | | | |
|---|---|---|---|
| 533809 | 3/1922 | France | 273/102 |
| 1297753 | 5/1962 | France | 273/30 |
| 996096 | 6/1965 | United Kingdom | 273/30 |

*Primary Examiner*—Richard C. Pinkham
*Assistant Examiner*—T. Brown

[57] ABSTRACT

The Guard, according to the embodiment described and depicted herein, comprises an elongate, table-top-engaging mount from which rises an inclined ball-rebounding face. The face and rib define an acute angle therebetween, as the face overlies the rib—to define an obtuse angle with the playing side of the table when the Guard is fixed to the table tennis table. Accordingly, the thus backwardly inclined face is disposed over the table net, and reaches back to engage a "play-back" board. The Guard has a channel with a board slidably and frictionally engaged with the channel, so that the reach of the Guard to a "play-back" board can be altered. As a result, the Guard blocks the net, and keeps the ball from falling behind the net and to the floor, so that the ball can remain in play.

4 Claims, 4 Drawing Figures

TABLE TENNIS BALL GUARD

This invention pertains to game apparatus and devices, and in particular to such apparatus and devices usable with table tennis, especially for sole play and/or practice and training.

Table tennis practice and training devices are numerous in the prior art and, typical thereof, the Ball Returning Target for Table Tennis, of U.S. Pat. No. 2,161,463, issued June 6, 1939, to H. P. Frost, comprises a device which may be used by a sole player. It offers individual practice and training. However, such devices allow the ball to fall behind the net from whence it falls to the floor and otherwise is out of play. Having repeatedly to retrieve the ball is annoying, at least. But more, it interrupts the player's timing and coordination. There has long been a need for a simple device which will block the net and bridge the gap therebehind to the "play-back" board (or table half).

It is an object of this invention to meet the aforesaid need. Particularly it is an object of this invention to set forth a table tennis ball guard comprising first means defining a table-engageable mount; and second means defining an inclined, ball-rebounding face; wherein said face has a ball-rebounding surface, and means for selectively and steplessly increasing and decreasing the area of said surface with infinite graduations.

Further objects of this invention, as well as the novel features thereof will become more apparent by reference to the following description taken in conjunction with the accompanying figures, in which.

Figure 1:
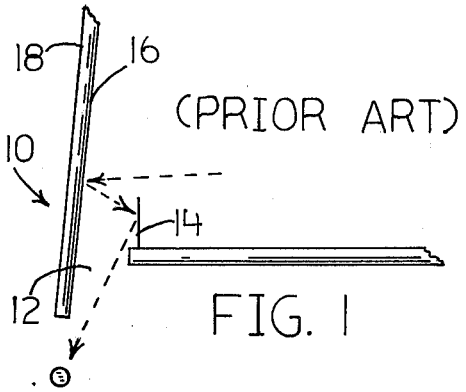
FIG. 1 is a line drawing of the prior art arrangement of a "play-back" table tennis without benefit of the invention.
Figure 2:
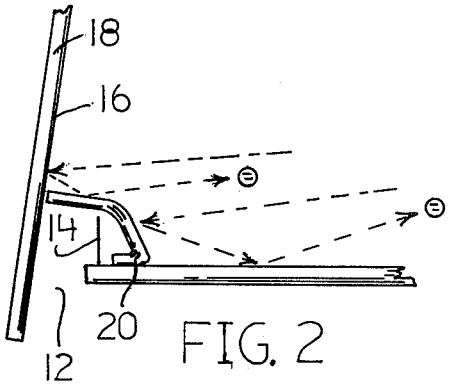
FIG. 2 is a line drawing, like that of FIG. 1, showing the novel table tennis ball guard in place.

As shown in the Figures, prior art "play-back" table tennis arrangements 10 define a gap 12 to the rear of the net 14 and the face 16 of the return panel 18. The gap 12 becomes a trap for the ball if it hits the rear of the net 14 on rebounding from face 16; the ball falls to the floor and causes an interruption of play.

Figure 3:
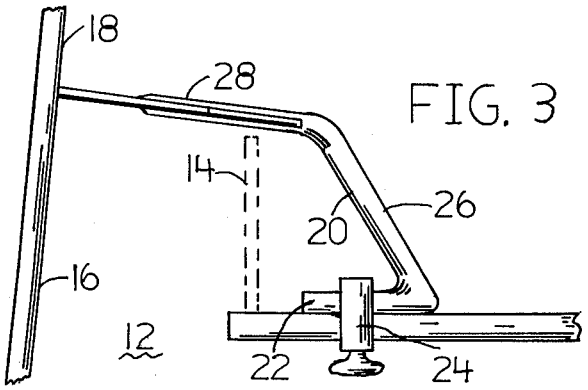
FIG. 3 is an end, elevational view of the invention, the scale herein being enlarged over FIGS. 1 and 2, shown in operative cooperation with a "play-back" table half.
Figure 4:
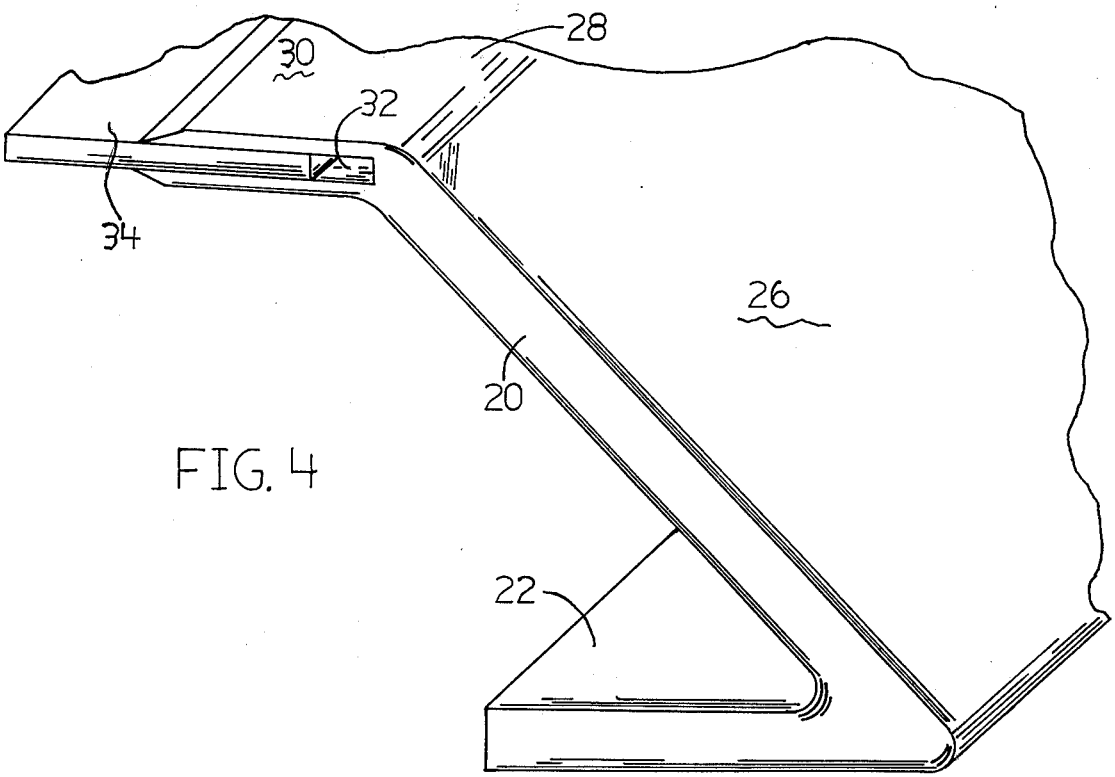
FIG. 4 is a fragmentary, isometric view of the novel guard which, in greater detail, shows the extension feature of the invention.

According to the invention, a ball guard 20 shields or blocks off the net 14 and forms a bridge over the gap 12. The guard 20 makes a contact with the face 16 and fully thereacross. The guard 20 has an elongate rib 22 which, at each end, receives a conventional clamp (only one being shown in FIG. 3) 24.

The guard 20 has a first net-shield surface 26 and a second gap-bridging surface 28. Balls which are hit too low simply rebound from surface 26 right back to the player, and surface 28 returns those balls which, in prior art devices, would have fallen behind the net 14—for returning too low, or with too shallow a trajectory.

Surface 28 is a composite comprised of the uppermost surface 30 of a channel 32 formed in an upper portion of guard 20. Channel slidably and frictionally receives and carries a board 34. Hence, the uppermost surface of board 34 constitutes the remaining portion of surface 28. Yet, in accord with the novelty of the invention, the area of surface 28 can be increased or decreased, simply by sliding the board 34 into or outwardly from the channel 32.

Board 34 comprises an extender. It provides an adjustable reach of the guard 20, so that the guard may be used on tables of various makes (i.e., manufacture) in which the width of the gap 12 varies from one to another.

It is intended that the guard 20 should be unobtrusive. That is, it is only to shield or block off the net 14 and return balls which would otherwise fall into gap 12. Accordingly, it rises but little more than does the net 14 from the table surface. Return surface 28 is only slightly elevated, simply to insure that balls landing thereupon will roll forward or rebound forwardly (i.e., toward the player).

While the guard 20 is shown fixed with clamps 24 to the table top, it will be appreciated that the rib 22 and the table can readily be pre-drilled to receive fasteners—by means of which the guard can be replaceably fixed to the table top, for use, or to the under surface of the table, for storage. Too, the embodiment shown employs a channel 32 and board 34 slidable therein. Patently, end tracks, or the like could be used to "extend" the board. Any alternative "extender" is believed to be within the ambit of my invention, as proceeding from my teaching herein. Because of its versatility, I propose that the guard 20 be fabricated of plastic. But of course, the invention is not limited to such material—or to any materials. That is to say that, while I have described my invention in connection with a specific embodiment thereof, it is to be clearly understood that this is done only by way of example, and not as a limitation to the scope of my invention as set forth in the objects thereof and in the appended claims.

I claim:

1. A table tennis ball guard, for use in combination with a table-tennis table and a ball-rebounding play-back board, comprising: means defining a table-engageable mount, for replaceably mounting said ball guard onto a table-tennis table; and said guard having first and second substantially planar ball rebound surfaces, and being adapted to extend substantially the width of a standard table tennis table; said table-engaging mount being an elongated substantially planar element and when in use, being on and substantially parallel to the upper surface of a table tennis table; said first rebound surface being attached to and extending upwardly from said mount and defining an acute angle therewith, said second surface being engaged with said first rebound surface in an edge-to-edge relationship and defining an obtuse angle with respect to said first rebound surface; when in use with a table tennis table having a table tennis net attached thereto and a ball play-back board positioned on one end thereof, said guard being mountable adjacent the net on the same side thereof as a player hitting a ball, said first rebound surface adapted to extend upwardly at an angle towards the net to a height of approximately table tennis net height, said second rebound surface adapted to extend from said first rebound surface, over the net and into abutting engagement with the ball play-back board.

2. A table tennis ball guard, according to claim 1, wherein: said amount-defining means comprises a rib; and said first ball-rebounding surface is rigidily and contiguously joined to said rib.

3. A table tennis ball guard, according to claim 2, wherein: said first ball-rebounding surface overlies said rib.

4. A table tennis table guard as defined in claim 1 wherein said second rebound surface is divided into a pair of connecting sections, one of said sections having a channel extending along the edge thereof, and the other section being received by said channel.

* * * * *